United States Patent [19]

Fuchs

[11] 4,120,432

[45] Oct. 17, 1978

[54] CASTOR

[76] Inventor: Dieter Fuchs, Westring 15-17, 4503 Dissen T.W., Fed. Rep. of Germany

[21] Appl. No.: 715,688

[22] Filed: Aug. 19, 1976

[30] Foreign Application Priority Data

Aug. 28, 1975 [DE] Fed. Rep. of Germany ... 7527172[U]

[51] Int. Cl.[2] ..... A47G 19/24

[52] U.S. Cl. ..... 222/565

[58] Field of Search ..... 222/189, 158, 565, 568, 222/452, 480, 486, 562; 220/253; 251/208, 206, 352

[56] References Cited

U.S. PATENT DOCUMENTS

| | | | |
|---|---|---|---|
| 2,385,677 | 9/1945 | Bailey | 222/452 |
| 2,877,937 | 3/1959 | Weir | 222/452 |
| 2,971,681 | 2/1961 | Galbierz | 222/480 X |
| 3,297,211 | 1/1967 | Unger | 222/562 X |
| 3,446,403 | 5/1969 | Serio | 222/158 |

*Primary Examiner*—Joseph F. Peters, Jr.
*Assistant Examiner*—Norman L. Stack, Jr.

[57] ABSTRACT

A castor for pulverous, granular or lumpy substances such as spices is disclosed. The castor comprises a hollow body, a cap insert provided with an aperture and adapted to close off an opening in the body apart from the aperture in the cap insert. The cap insert rotatably supports a cover slide provided with a sieve plate having a plurality of differently apertured regions which — on rotation of the slide — can be selectably positioned over the aperture in the cap insert. The slide is provided with a sleeve structure connected to the sieve plate and having a plurality of sleeve elements each encompassing a respective one of the apertured regions in the sieve plate. Each sleeve element extends substantially perpendicularly from the side of the sieve plate remote from the cap insert to contact the underside of a lid on the latter being received by the castor.

4 Claims, 5 Drawing Figures

FIG. 4
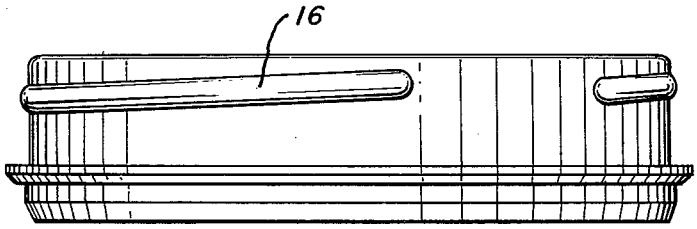
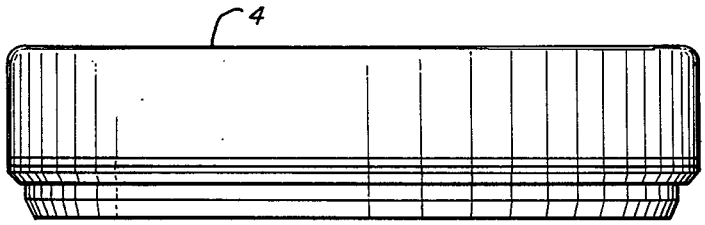
FIG. 5

CASTOR

BACKGROUND OF THE INVENTION

The present invention relates to a castor for pulverous, granular or lumpy substances, especially for spices and the like food additive substances.

The present invention relates more particularly to a castoer comprising a hollow body provided with an opening across which extends a portion of a cap insert, on which is rotatably mounted a cover forming a sieve plate. The portion of the cap insert which extends across the opening is provided with an aperture defining a main passage opening for the interior of the hollow caster body and the sieve plate is provided with a plurality of spatially differentiated regions each having at least one passage therethrough.

A known form of construction of a castor of this kind possesses a circularly shaped cover slide, which is rotatable about its centre point and which is so positionable relative to the insert that either any selected one of the apertured regions of the cover slide may be disposed over the main passage opening or, after appropriate rotation, the slide may be so positioned as to close entirely the main passage opening which is disposed eccentrically relative to the axis of rotation of the insert. The differently apertured regions of the slide are disposed beside one another in a limited angular range to facilitate selection of different grain or lump sizes by appropriate positioning of the cover slide.

SUMMARY OF THE INVENTION

According to the present invention, there is provided a castor for pulverous, granular of lumpy substances such as spices comprising a hollow body having an opening, a cap insert received by the body and having a portion extending across the opening, a lid adapted to be received by the castor, a cover slide provided with a sieve plate and a sleeve structure connected to the sieve plate, the sieve plate being provided with a plurality of spaced regions each having at least one passage therethrough, the passages in respective ones of said regions being differently sized, the cover slide being rotatably displaceable relative to the cap insert to selectably position any one of said regions of the sieve plate in overlying relationship with an aperture in said portion of the cap insert, the sleeve structure having a plurality of sleeve elements each encompassing a respective one of said regions and each projecting substantially perpendicularly from the side of the sieve plate remote from said portion of the cap insert to contact the underside of the lid on the latter being received by the castor.

The sleeve structure of the rotary cover slide tends to prevent the contents of the castor from collecting in the cavity defined between rotary slide and the lid when the cover slide has not been closed after the lid has been replaced. Moreover, the sleeve structure sub-divides this cavity into individual compartments or segments, each associated with only one of the differently apertured regions of the sieve plate. The sub-division limits the maximum lump size of the scatter material from the castor which — on shaking or tilting of the castor + can get into the cavity between the rotary cover slide and the lid to that which can pass through the sieve holes of the particular apertured region of the cover slide disposed opposite the main passage opening. Furthermore, the sleeve structure prevents the lumps from being distributed laterally over the other regions of the sieve plate. Thus, relatively large size particles or lumps are prevented by the sleeve structure from being deposited in front of sieve regions provided with small openings and, therefore during the next following use of the castor, the desired dosage cannot be falsified by the presence of such oversize particles. Thus, the entire apertured portion of the sieve plate as well as each individual apertured region is closed off laterally by the sleeve structure, which limits the scattering range of the issuing scatter material and makes possible a controlled scattering.

The sleeve structure may be an integral component of the cover slide. The cover slide may comprise translucent or transparent material so as to facilitate — during the manipulation of the castor — the seeking of the desired association of main passage opening of the insert with the selected apertured region of the cover slide.

BRIEF DESCRIPTION OF THE DRAWINGS

An embodiment of the present invention will now be more particularly described by way of example with reference to the accompanying drawing, in which:

FIG. 4 shows a side elevation of the insert as shown in FIGS. 1 and 2 and FIG. 5 shows a side elevation of the lid.

DESCRIPTION OF THE PREFERRED EMBODIMENT

Figure 3:
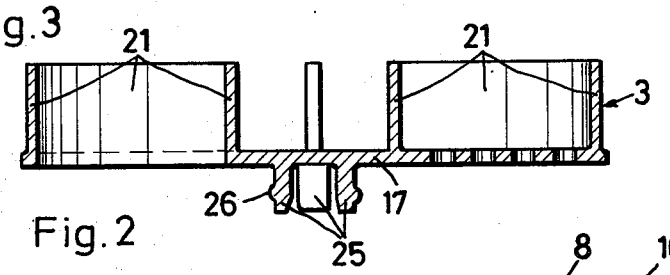
FIG. 3 shows a cross-section of the cover slide for an insert as shown in FIG. 2, likewise along the line II—II in FIG. 1.
Figure 2:
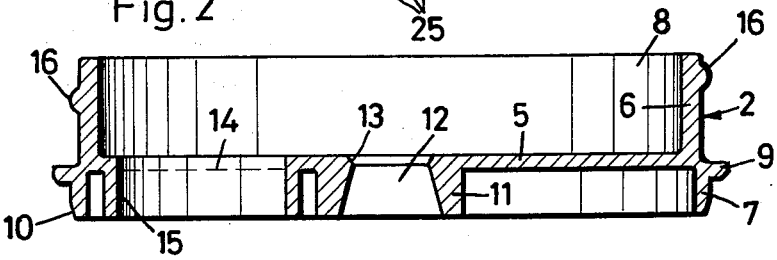
FIG. 2 shows a cross-section through the insert of a castor along the line II—II in FIG. 1.

Referring now to the accompanying drawings, a cylindrical castor body comprising a castor wall and a castor bottom, is closed off at its upper side by a cap insert 2 provided with a cover slide 3 and by a lid 4 fitting over both insert and cover slide.

The castor body is preferably cylindrical. The insert 2 possesses a substantially circular plate portion 5, planar at its upper side, with an upper annular circumferential flange 6 and a lower circumferential flange 7 which — for a cylindrical castor body — is likewise constructed to be circularly shaped and has external diameter corresponding to the internal diameter of the castor body. However, the insert has a cross-sectional configuration adapted to the opening cross-section of the castor, for example the insert and the castor may each be of square cross-section. The upper circumferential flange 6 together with the upper side of the plate 5 forms a cylindrical cavity 8 to accommodate the cover slide 3. The insert 2 is insertable by its lower circumferential flange 7 in axial direction into the upper opening cross-section of the castor body up to an abutment collar 9 bounding the lower circumferential flange 7. The insertion is facilitated by a bevel 10 at the outer edge of the circumferential flange 7, which is connected with the castor body by cementing, welding or simply only by being wedgingly pressed in. Thus, the cap insert 2 is received by the hollow body of the castor so that the plate portion 5 extends across the opening in the hollow castor body. The opening may be defined by a necked portion of the castor body.

The round plate 5 of the insert 2 is provided with two apertures, which are each provided with a downwardly protruding edging collar, which both end in a radial plane determined by the lower edge of the circumferential flange 7. A hub projection 11 is provided in the middle of the plate 5. The hub projection 11 defines a bore 12 conically enlarging downwardly and having a chamfer 13 at the upper inside rim. A large aperture defining a main passage opening 14 is disposed at a radial spacing from the hub projection 11. The main passage opening 14 extends over the area of a 60° sector which ends closely to the upper circumferential flange 6. A downwardly directed collar 15 starting at the rim of the passage opening 14 runs in radial direction at two sides corresponding to the sector boundaries and therebetween in the shape of a circular arc at a spacing from the lower circumferential flange 7 or from the hub projection 11.

The outer edge of the abutment collar 9 projects out so far relative to the circumferential surface of the lower circumferential flange 7 that it closes off with the castor wall when the insert has been received by the castor body. The circumference of the lid 4, executed either as a push-on or as a screw-on lid, is also adapted to the circumference of the castor wall. The upper circumferential flange 6 carrying the round lid 4 for the attainment of a screw closure is provided at the outside for example with inclined ribs 16 distributed over the circumference and intended for engagement with an internal thread or with inclined counter-ribs (not illustrated) provided at the inside wall of the lid 4.

The cover slide 3 comprises a circular rotary plate 17, one half of which is uninterrupted and the other half of which forms a sieve plate with substantially sector-shaped apertured regions 18, 19 and 20. The apertured regions in their basic area each conform with the shape of the passage opening 14 in the insert 2. The apertured region 18 is defined by a single passage opening which is approximately co-extensive in cross-section with that of the main passage 14. The apertured region 19 is provided with a plurality of apertures defining a coarse sieve and the apertured region 20 is provided with a plurality of apertures which are of smaller size than those in the region 19 to define a relatively fine sieve. Each sieve region — except the region 18 in the perforate zone of the plate 17 — is provided with circular apertures or passages. The rotary plate 17 may comprise either translucent or transparent material in order to facilitate finding the desired super-imposition relationship between the rotary plate 17 and the passage opening 14.

Figure 1:
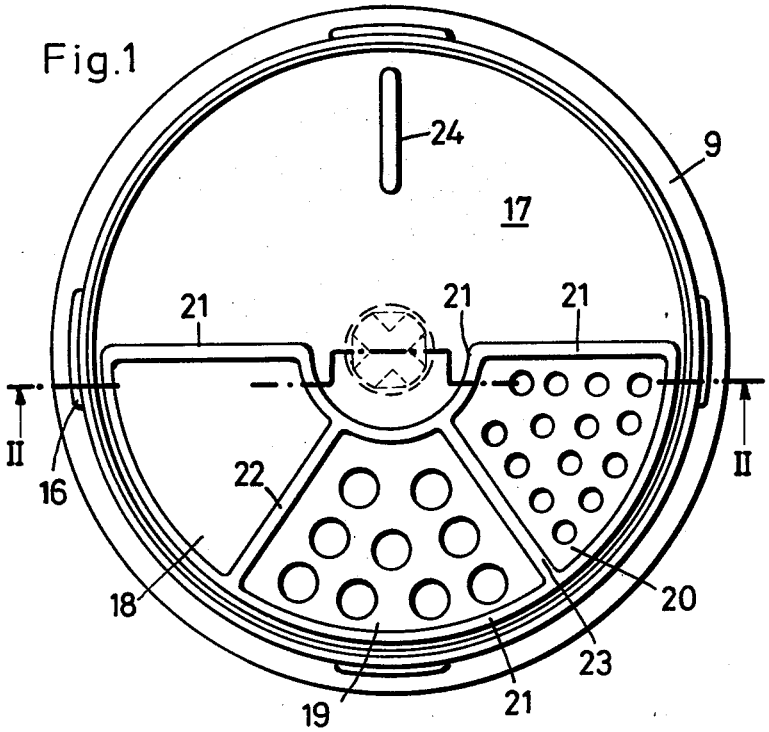
FIG. 1 shows a plan view of a castor embodying the invention with the lid removed.

The apertured regions 18, 19 and 20 altogether are surrounded by a standing sleeve portion 21, which extends perpendicularly from the side of the rotary plate 17 remote from the plate portion 5 and which at the outside runs substantially at or near the edge of the rotary plate 17 and at the inside likewise semi-circularly at a radial spacing from the centre point of the rotary plate and which includes radially extending wall portions. Additionally, the aperture regions 18, 19 and 20 are separated by intermediate standing sleeve portion 22 and 23. In the preferred embodiment, the intermediate standing sleeve portions 22 and 23 are of the same thickness and height as the standing sleeve portion 21. However, the underside of the lid may be shaped to contact the sleeve portions which are of different height. Thus, the sleeve structure is provided with a plurality of sleeve elements so arranged that each respective apertured region of sieve plate is encompassed by an element of the sleeve structure. As indicated in FIG. 1 the sleeve structure portion 21 also encompasses the entire apertured zone of the sieve plate. The respective sleeve elements may be integral with one another, an in the preferred embodiment, or may be spaced apart.

A rib 24, likewise extending upwardly from the plate 17 and of the same thickness and height as the standing collars, runs in radial direction in the centre of the unapertured area of the rotary plate 17, which can be gripped on both sides and facilitates the manipulation of the cover slide 3.

Opposite the substantially planar underside of the rotary plate 17, four tongues 25 project in the centre in the manner of a spigot slotted cross-wise and by beads 26 resiliently notch into the conical part of the bore 12 on the cover slide 3 being inserted into the cavity defined by the insert 2. The four tongues 25 interact with the wall of the bore 12 to guide the plate 5 of the insert 2 and the rotary plate 17 of the cover slide 3 rotatably relative to one another and to maintain the rotary plate 17 in close contact with the plate 5. The inserted cover slide 3 protrudes so far by its standing sleeve portion 21 and the intermediate sleeve portions 22 and 23 that its upper edge surface is aligned with the upper boundary edge surface of the insert 2 and thus comes into flush contact against the inner surface of the lid 4, when the latter is received by being pushed on or screwed on the insert. Thus, the aperture regions 18, 19 and 20 — on the castor being closed — are closed off against one another and against the region between the unapertured part of the rotary plate 17 and the lid 4. On shaking or tilting of the closed castor, scatter material can in all cases issue through the aperture regions 18, 19 and 20 into the respectively bounded region lying thereover and on the setting up of the castor bottom easily fall back again, but not in any case transgress into other regions.

In advantageous manner, the castor can be so cladded on the inside by a film or layer of material as to be rendered air-tight and light-tight. In that case, the inside cladding of the castor wall and the castor bottom is complemented to a closed enveloping of the scatter material by a layer of material which is arranged to extend across the opening and below the insert 2. The layer of sealing material can in that case bear against the lower edge of the circumferential flange 7, beyond that against the lower edges of the hub projection 11 and the collar 15 and be connected with these in suitable manner. At the outside, the layer of sealing material can bear against the circumference of the circumferential flange 7, wherein the bevel 10 offers a wedging gap for the reception of the edge of the layer and facilitates the pushing in of the insert with the layer into the castor wall likewise cladded with a film or a layer of such sealing material, in a given case with a certain prestressing. A preferred sealing material is aluminium foil of a thickness of about 0.008 to 0.012 millimetres, which is coated on the inside with a PVC-mixture-polymerisate and on the outside with a polymethacryl acid ester, seamed by hot sealing or ultrasonic welding and being connected with the castor. Additionally or subadditionally, fusion lacquers can be employed for the execution of the connections, instead of aluminium foil, a layer of viscose material can also find application and then preferably be provided on one or both sides with a coating of PVDC, which in its turn permits the fixing of the layer by welding or hot sealing.

For taking into use the castor closing off in air-tight and light-tight manner the scatter material all round by a layer of sealing material on super-imposition of the aperture region 18 of the cover slide 3 and the passage opening 14 of the insert 2, the layer of sealing material lying thereunder is perforated and pushed to one side. Thereafter, the passage opening 14 can be covered or opened as desired by bringing the different aperture regions 18, 19 and 20 or however also the unapertured region of the rotary plate 17 into co-incidence with the passage opening 14.

In the preferred embodiment of the invention, the lid 4 is a push-fit or a screw-fit on the flange portion 6 of the cap insert 2. However, the lid may be adapted to be similarly received by a neckportion of the castor body itself.

I claim:

1. A castor for pulverous, granular or lumpy substances such as spices, comprising in combination:

(a) a cylindrical hollow body having an opening;

(b) a cylindrical cap insert adapted to be matingly received by said hollow body and having a portion extending across said opening when said cap insert is mounted in said hollow body, said portion having a main aperture, said cap insert having an externally threaded neck therein;

(c) a cylindrical lid adapted to be mounted on said cap insert and having an internal threaded portion which is adapted to threadably engage said neck of said cap insert;

(d) a cylindrical cover slide rotatably mounted within said cap insert, said cover slide having a sieve plate and wall means projecting from said sieve plate which surround and separate a plurality of perforate regions in said sieve plate and are adapted to coact with the underside of said lid to effectively separate and seal from each other the perforate regions of said sieve plate when the lid is fully mounted on the cap insert, the free edges of said wall means most remote from said sieve plate being in flush contact with the interior surface of said lid when the lid is mounted on the cap insert and thereby closes said castor.

2. A castor as defined in claim 1, wherein said wall means are integral with said cover slide.

3. A castor as defined in claim 1, wherein said wall means are coextensive relative to said sieve plate.

4. A castor as defined in claim 1, wherein the inside surface of the hollow body and the underside of the cap insert are each provided with a layer of material to close off the interior of the castor.

* * * * *